US011045867B2

(12) United States Patent
Konishi et al.

(10) Patent No.: US 11,045,867 B2
(45) Date of Patent: Jun. 29, 2021

(54) CONTINUOUS CASTING MOLD, CONTINUOUS CASTING DEVICE, AND CONTINUOUS CASTING METHOD

(71) Applicant: Kabushiki Kaisha Kobe Seiko Sho (Kobe Steel, Ltd.), Kobe (JP)

(72) Inventors: Yuki Konishi, Inabe (JP); Kenichi Hirukawa, Inabe (JP); Hiroki Sawada, Inabe (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 16/738,141

(22) Filed: Jan. 9, 2020

(65) Prior Publication Data

US 2020/0254514 A1 Aug. 13, 2020

(30) Foreign Application Priority Data

Feb. 12, 2019 (JP) ..... JP2019-022788

(51) Int. Cl.
*B22D 11/124* (2006.01)
*B22D 11/22* (2006.01)
*B22D 11/04* (2006.01)

(52) U.S. Cl.
CPC ..... *B22D 11/1246* (2013.01); *B22D 11/04* (2013.01); *B22D 11/22* (2013.01)

(58) Field of Classification Search
CPC ... B22D 11/1246; B22D 11/049; B22D 11/22; B22D 11/225
See application file for complete search history.

(56) References Cited

U.S. PATENT DOCUMENTS

2002/0174971 A1* 11/2002 Langlais ..... B22D 11/049 164/487

FOREIGN PATENT DOCUMENTS

JP 2011-131245 A 7/2011

* cited by examiner

*Primary Examiner* — Kevin E Yoon
(74) *Attorney, Agent, or Firm* — Oblon, McClelland, Maier & Neustadt, L.L.P.

(57) ABSTRACT

A crack-free continuous casting mold configured so that occurrence of cracks at a casting billet can be reduced even in a case where a casting speed exceeds 500 mm/min. The continuous casting mold continuously casts a casting billet while cooling molten metal by a cooling device provided at a cooling casting mold. The cooling device includes multiple cooling nozzles configured to release coolant water to the casting billet pulled out of the cooling casting mold to cool the casting billet. Multiple ejection ports of the multiple cooling nozzles are arranged along an outer circumferential direction of a surface of the casting billet. Each ejection port has a short side and a long side, and is configured such that the long side is arranged along an axial direction of the casting billet.

8 Claims, 10 Drawing Sheets

CONTINUOUS CASTING MOLD, CONTINUOUS CASTING DEVICE, AND CONTINUOUS CASTING METHOD

BACKGROUND OF THE INVENTION

Field of the Invention

The present invention relates to a continuous casting mold, a continuous casting device, and a continuous casting method used for continuously casting metal casting billets.

Description of the Related Art

Typically, a horizontal continuous casting device described in JP2011-131245A has been known as a device configured to continuously cast a casting billet from molten metal such as aluminum alloy while cooling the casting billet by a cooling device, for example.

The horizontal continuous casting device described in JP2011-131245A includes the cooling device including a primary cooling water jacket, a secondary cooling nozzle, and a tertiary cooling nozzle for reducing occurrence of cracks at the casting billet even when casting is performed at a casting speed of equal to or lower than 500 mm/min.

In such a cooling device, a coolant water collision position interval (Y) to a tertiary coolant water collision center position at which coolant water released from the tertiary cooling nozzle collides with the casting billet is set to have a ratio (R) of 30% to 60% with respect to the diameter of the casting billet. Moreover, the cooling device is configured to cool the casting billet with the coolant water of the water jacket at three stages of the water jacket, the secondary cooling nozzle, and the tertiary cooling nozzle, thereby reducing occurrence of the cracks (also referred to as "ingot cracks").

However, in the continuous casting device described in JP2011-131245A, in a case where the casting billet is casted at a high speed exceeding a casting speed of 500 mm/min for further improving productivity, there is a probability that cracks are caused at a center portion of the casting billet (an ingot).

For this reason, the present invention is intended to provide a continuous casting mold, a continuous casting device, and a continuous casting method configured so that occurrence of cracks at a casting billet can be reduced even in a case where a casting speed exceeds 500 mm/min.

For solving the above-described problem, the continuous casting mold of the present invention is a continuous casting mold for continuously casting a casting billet while cooling molten metal by a cooling device provided at a cooling casting mold. The cooling device includes multiple cooling nozzles configured to release coolant water to the casting billet pulled out of the cooling casting mold to cool the casting billet. Multiple ejection ports of the multiple cooling nozzles are arranged along an outer circumferential direction of a surface of the casting billet. Each ejection port has a short side and a long side, a short axis or a long axis, or a long axis or a center line crossing the long axis, is formed in a shape elongated in a long side direction or a long axis direction, and is configured such that the long side or the long axis is arranged along an axial direction of the casting billet.

According to such a configuration, the continuous casting mold is configured such that the multiple ejection ports of the cooling nozzles configured to release the coolant water to the casting billet pulled out of the cooling casting mold when the casting billet is continuously casted at a high casting speed are arranged along the outer circumferential direction of the surface of the casting billet. The ejection port of the cooling nozzle has the short side and the long side, the short axis and the long axis, or the long axis and the center line crossing the long axis, is formed in the shape elongated in the long side direction or the long axis direction, and is configured such that the long side or the long axis is arranged along the axial direction of the casting billet. Thus, the casting billet can be efficiently cooled across a wide area in the axial direction. Consequently, even in a case where the casting speed exceeds 500 mm/min, occurrence of cracks at the casting billet can be reduced.

Moreover, the continuous casting mold of the present invention is a continuous casting mold for continuously casting a casting billet while cooling molten metal by a cooling device provided at a cooling casting mold. The cooling device includes multiple cooling nozzles configured to release coolant water to the casting billet pulled out of the cooling casting mold to cool the casting billet. The multiple cooling nozzles include multiple ejection ports arranged along a long side direction in an ejection port area having a short side and a long side and formed in a shape elongated in the long side direction. The ejection port area includes multiple ejection port areas arranged along an outer circumferential direction of a surface of the casting billet, and the long side of each ejection port area is arranged along an axial direction of the casting billet.

According to such a configuration, the continuous casting mold includes the cooling device having the multiple cooling nozzles configured to release the coolant water to the casting billet pulled out of the cooling casting mold to cool the casting billet. The cooling nozzles include the multiple ejection ports arranged along the long side direction in the ejection port area having the short side and the long side and formed in the shape elongated in the long side direction. The ejection port area includes the multiple ejection port areas arranged along the outer circumferential direction of the surface of the casting billet, and the long side of each ejection port area is arranged along the axial direction of the casting billet. Thus, the casting billet can be efficiently cooled across a wide area in the axial direction. Consequently, even in a case where a casting speed exceeds 500 mm/min, occurrence of cracks at the casting billet can be reduced.

The ejection port of the cooling nozzle may be formed to have an ejection port short side length of 0.1 mm to 5.0 mm.

According to such a configuration, the ejection port of the cooling nozzle is formed in an elongated shape (a slit shape) having a short side length of 0.1 mm to 5.0 mm. Thus, the coolant released from the ejection port of the cooling nozzle continuously contacts, due to the shape of such an ejection port, the casting billet across a wide area in a casting direction, and can efficiently cool the casting billet.

The ejection port area of the cooling nozzles may be formed to have an ejection port area short side length of 0.1 mm to 5.0 mm.

According to such a configuration, the ejection port area of the cooling nozzles is formed in an elongated shape (a slit shape) having a short side length of 0.1 mm to 5.0 mm. Thus, the coolant released from the multiple ejection ports in the ejection port area continuously contacts, due to the shape of such an ejection port area, the casting billet across a wide area in the casting direction, and can efficiently rapidly cool the casting billet.

The ejection port of the cooling nozzle may be formed to have an ejection port long side length of 2.5 mm to 20.0 mm, and a ratio between the short side and the long side may be five times or more.

According to such a configuration, the ejection port of the cooling nozzle is in such an elongated shape that the length of the long side of the ejection port is equal to or greater than five times as long as the length of the short side, and therefore, the coolant can be released across a wide area.

The ejection port area of the cooling nozzles may be formed to have an ejection port area long side length of 2.5 mm to 20.0 mm, and a ratio between the short side and the long side may be five times or more.

According to such a configuration, the ejection port area of the cooling nozzles is in such an elongated shape that the length of the long side of the ejection port area is equal to or greater than five times as long as the length of the short side, and therefore, the coolant can be released across a wide area.

The shape of the ejection port of the cooling nozzle may be a rectangular shape, an elliptical shape, an oval shape, an egg shape, a trapezoidal shape, or a triangular shape.

According to such a configuration, the shape of the ejection port of the cooling nozzle can provide similar advantageous effects even in the case of other shapes than a circular shape, such as a quadrangular shape or an elliptical shape.

The shape of the ejection port in the ejection port area of the cooling nozzles may be a square shape, a rectangular shape, a circular shape, an elliptical shape, an oval shape, an egg shape, a trapezoidal shape, or a triangular shape.

According to such a configuration, the shape of the ejection port in the ejection port area of the cooling nozzles can provide similar advantageous effects even in the case of, e.g., a quadrangular shape or an elliptical shape.

The ejection port of the cooling nozzle may be arranged inclined with respect to a radial direction perpendicular to the axis of the casting billet.

According to such a configuration, the ejection port of the cooling nozzle is arranged inclined with respect to the radial direction perpendicular to the axis of the casting billet. Thus, as compared to a case where the long side is arranged in the radial direction perpendicular to the axis of the casting billet, the coolant water can contact the casting billet across a wide area in a circumferential direction to efficiently cool the casting billet.

The ejection port area of the cooling nozzles may be arranged inclined with respect to the radial direction perpendicular to the axis of the casting billet.

According to such a configuration, the ejection port area of the cooling nozzles is arranged inclined with respect to the radial direction perpendicular to the axis of the casting billet. Thus, as compared to a case where the long side of the ejection port area is arranged in the radial direction perpendicular to the axis of the casting billet, the coolant released from the multiple ejection ports in the ejection port area can contact the casting billet across a wide area in the circumferential direction to efficiently cool the casting billet.

The ejection port of the cooling nozzle may be formed in a rectangular shape, a distance L1 until completion of solidification after the start of solidification of an ingot forming the casting billet cooled with the coolant water released from the ejection port may be set to satisfy Expression (1) below, and the length β of the long side of the ejection port may be set to satisfy Expression (2) below:

[Expression 1]

$$L1 = \frac{\left(\frac{D}{2} - \delta\right)}{\tan\psi} \qquad \text{Expression (1)}$$

[Expression 2]

$$\beta \geq L1 \times \sin\phi \qquad \text{Expression (2)}$$

where in Expressions (1) and (2),

L1 represents the distance (mm) until completion of solidification after the start of solidification of the ingot, D represents the diameter (mm) of the casting billet, δ represents the thickness (mm) of a solidified shell layer of the casting billet, ψ represents the solidification angle (degrees) of a boundary between the molten metal and the solidified ingot with respect to a center line of the casting billet, β represents the length (mm) of the long side of the ejection port, and ϕ represents an angle (degrees) between a surface of the cooling nozzle perpendicular to the casting direction and an inclined surface (a nozzle surface).

According to such a configuration, the ejection port of the cooling nozzle is formed in the rectangular shape, and therefore, the length of a coolant water collision region, where the coolant water released from the ejection port collides with an outer peripheral surface of the casting billet, in the casting direction is long. For the cooling nozzle, the length β of the long side of the ejection port is set such that the coolant water contacts equal to or greater than the distance L1 until completion of solidification after the start of solidification of the ingot forming the casting billet. Moreover, the cooling nozzle is set such that the angle with respect to the casting direction of the casting billet is diagonal. Thus, the coolant water released from the cooling nozzle can continuously contact the casting billet across a wide area in the casing direction, and can efficiently cool the casting billet to prevent occurrence of cracks.

The ejection port of the cooling nozzle may be formed in a rectangular shape, and a coverage ratio C defined by Expression (3) below may be set to 60% to 100% as in Expression (4):

[Expression 3]

$$C = \frac{N \times (\cos\theta \times (\alpha + \beta \times \tan\theta))}{D \times \pi} \times 100 \qquad \text{Expression (3)}$$

[Expression 4]

$$60 \leq C \leq 100 \qquad \text{Expression (4)}$$

where in Expressions (3) and (4),

C represents the coverage ratio (%),

N represents the number (ports) of ejection ports of the cooling nozzles,

θ represents the inclination angle (degrees) of the ejection port of the cooling nozzle with respect to the radial direction perpendicular to the axis of the casting billet, α represents the length (mm) of the short side of the ejection port of the cooling nozzle, β represents the length (mm) of the long side of the ejection port of the cooling nozzle, D represents the diameter (mm) of the casting billet, and π represents a circle ratio.

According to such a configuration, the ejection port of the cooling nozzle is formed in the rectangular shape, and the coverage ratio C is set to 60% to 100%. Thus, the ejection port can be in an optimal shape for efficiently cooling the continuously-casted casting billet across a wide area in the circumferential direction.

The continuous casting device according to the present invention may have a configuration using the continuous casting mold.

According to such a configuration, the continuous casting device includes the continuous casting mold, and therefore, even in a case where the casting speed exceeds 500 mm/min, occurrence of the cracks at the casting billet can be reduced.

The continuous casting method according to the present invention may manufacture, using the continuous casting mold, the casting billet pulled out of the cooling casting mold while cooling the casting billet with the coolant water released from the cooling nozzles.

According to such a procedure, the continuous casting method manufactures, using the continuous casting mold, the casting billet pulled out of the cooling casting mold while causing the coolant water released corresponding to the shape of the cooling nozzles to contact a wide area in the casting direction to cool the casting billet. Thus, even in a case where the casting speed exceeds 500 mm/min, occurrence of the cracks at the casting billet can be reduced.

According to the continuous casting mold, the continuous casting device, and the continuous casting method according to the present invention, even in a case where the casting speed exceeds 500 mm/min, occurrence of the cracks at the casting billet can be reduced.

DESCRIPTION OF THE PREFERRED EMBODIMENTS

Hereinafter, an embodiment of the invention will be described with reference to FIGS. 1 to 9.

«Continuous Casting Device»

Figure 1:
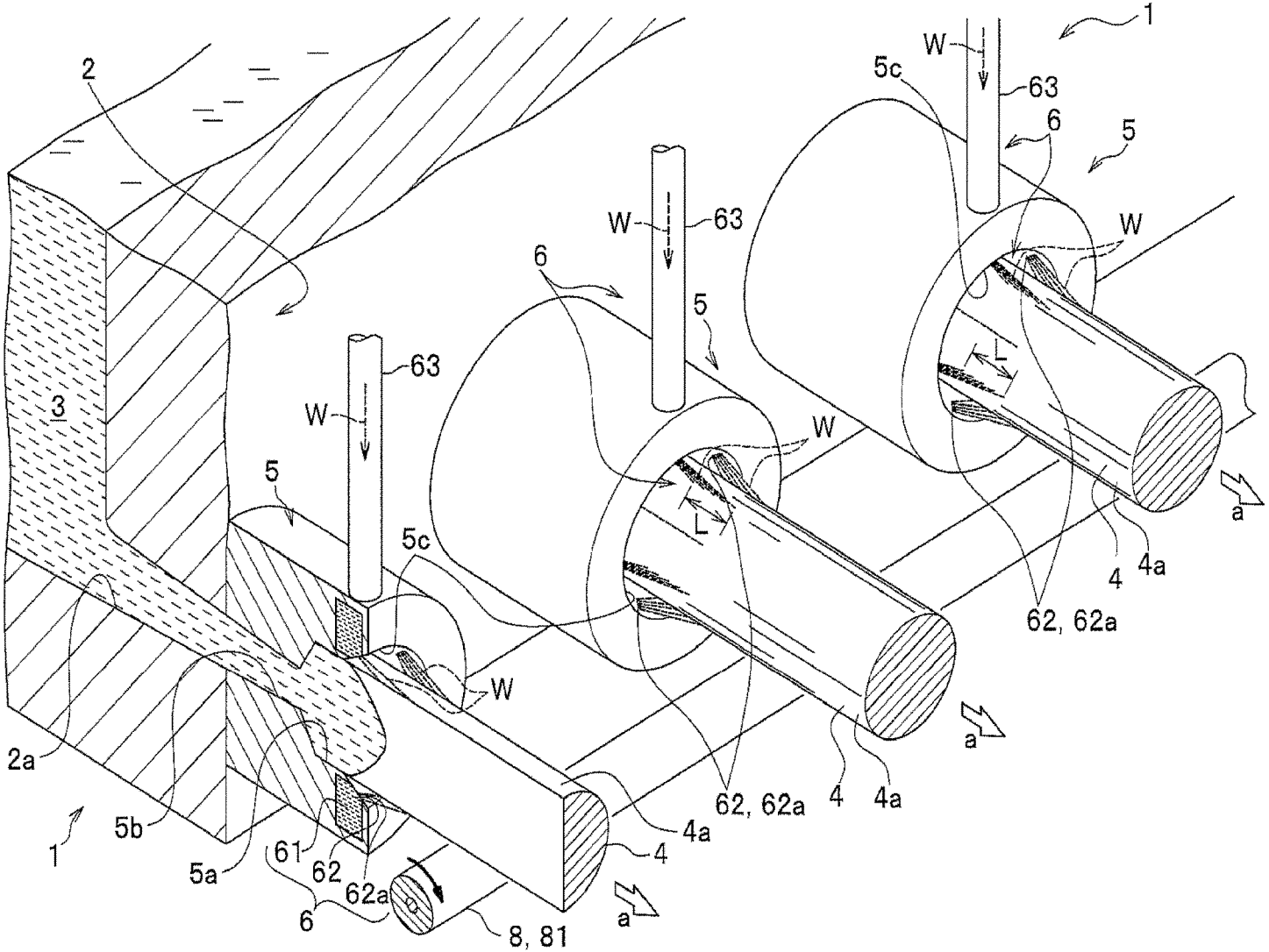
FIG. 1 is a perspective view of a main portion having a partial section, FIG. 1 illustrating a continuous casting device according to an embodiment of the present invention.

As illustrated in FIG. 1, a continuous casting device 1 is a device configured to continuously cast round bar-shaped casting billets 4 (ingots) while cooling the casting billets 4 by cooling devices 6 and sending the casting billets 4 in the horizontal direction when the casting billets 4 are solidified and casted from molten metal 3. The continuous casting device 1 includes a tundish 2 configured to store the molten metal 3 degassed in a degassing furnace, cooling casting molds 5 (continuous casting molds) to which the molten metal 3 is supplied, the cooling devices 6 configured to cool the cooling casting molds 5 and the casting billets 4, and a delivery device 8 configured to deliver the casting billets 4. The continuous casting device 1 is, for example, a casting mold device capable of continuously casting the casting billets 4 at a high casting speed V exceeding 500 mm/min «Tundish»

The tundish 2 is a furnace configured to temporarily store the molten metal 3 melted in a melting furnace (not shown) in a warm state. At a side wall of a lower portion of the tundish 2, casting ports 2*a* for supplying the molten metal 3 into the cooling casting molds 5 are formed.

«Molten Metal and Casting Billet»

The molten metal 3 is metal melted in the melting furnace (not shown), and for example, is made of aluminum alloy or magnesium alloy.

Moreover, the casting billet 4 is a casting piece (an ingot) casted by the continuous casting device 1 and solidified from the molten metal 3. The casting billet 4 is, for example, casted into a round bar having a diameter D (see FIG. 2) of about 40 mm to about 120 mm.

«Cooling Casting Mold»

Figure 2:
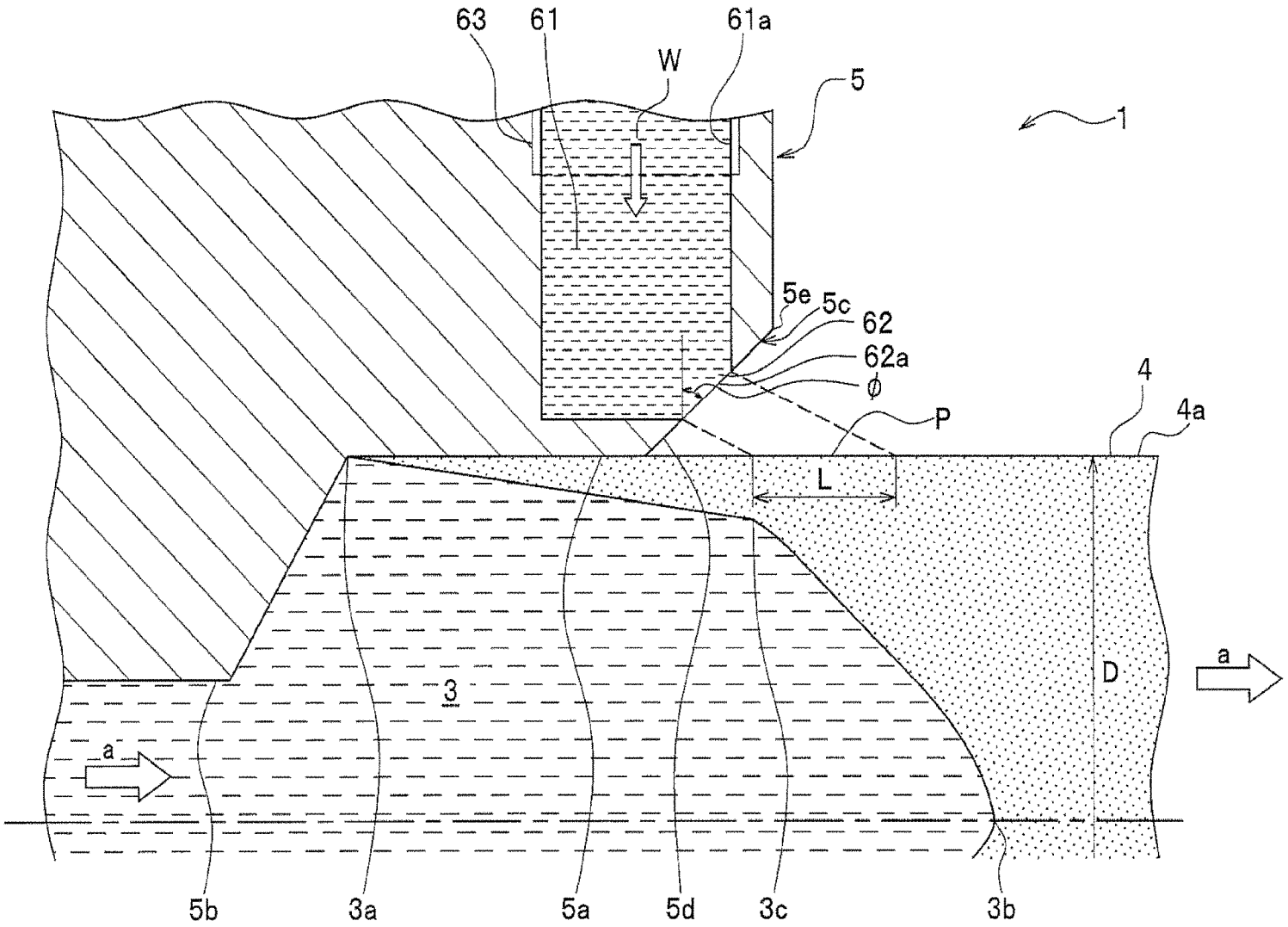
FIG. 2 is an enlarged longitudinal sectional view of a main portion illustrating an arrangement state of cooling nozzles of cooling casting molds.

The cooling casting mold 5 is a substantially-tubular casting mold configured to continuously cast, as the billet-shaped casting billet 4, the molten metal 3 supplied into the mold through a molten metal supply port 5*b* while forcibly cooling the molten metal 3 by the cooling device 6 provided at the cooling casting mold 5. As illustrated in FIG. 2, the cooling casting mold 5 is, as described later, provided with a casting mold surface 5*a*, the molten metal supply port 5*b*, an opening 5*c*, an inclined surface 5*d*, a water jacket 61, and cooling nozzles 62. The multiple cooling casting molds 5 are fixed to a lower surface of the tundish 2. The cooling casting mold 5 is made of metal having a high heat conductivity, such as copper alloy.

As illustrated in FIGS. 1 and 2, the molten metal supply port 5*b* is a supply port for supplying the molten metal 3 in the tundish 2. The molten metal supply port 5*b* communicates with the casting port 2*a* of the tundish 2.

The casting mold surface 5*a* is a mold surface of the cooling casting mold 5 for casting the billet-shaped casting billet 4 from the molten metal 3. The casting mold surface 5*a* described herein is formed continuously to the molten metal supply port 5*b* in a sleeve shape (a cylindrical shape) through a step, and is provided at an inner wall surface of the cooling casting mold 5.

As illustrated in FIG. 2, the opening 5*c* has the inclined surface 5*d* formed to expand the diameter thereof from an end portion of the casting mold surface 5*a* on a casting direction (downstream direction) side to an opening end 5*e*. Thus, the inside of the opening 5*c* is formed in a tapered shape (a substantially trumpet shape). Ejection ports 62*a* of the cooling nozzles 62 are formed at the opening 5*c*.

The inclined surface 5*d* is formed inclined at a predetermined angle (an angle $\phi$) such that the ejection ports 62*a* of the cooling nozzles 62 for releasing coolant water W to the casting billet 4 are placed apart from the casting billet 4 in a radial direction. At the inclined surface 5*d*, the multiple ejection ports 62*a* of the cooling nozzles 62 are arranged at predetermined intervals preset in a circumferential direction (see FIG. 6). The ejection port 62*a* formed at the inclined surface 5*d* is formed in a state inclined at the angle $\phi$ between a surface of the cooling nozzle 62 perpendicular to a casting direction and the inclined surface 5*d*. The angle $\phi$ between the surface of the cooling nozzle 62 perpendicular to the casting direction and the inclined surface 5*d* will be described later in detail. As described above, the inclined surface 5*d* is inclined, and therefore, right after ejection from the casting mold surface 5*a*, the coolant water W released from the ejection port 62*a* can continuously contact a wide area of an outer peripheral surface 4*a* of the casting billet 4 in the casting direction.

«Cooling Device»

The cooling device 6 is a device configured to cool the cooling casting mold 5 and the casting billet 4. Refrigerant used for the cooling device 6 is the coolant water W such as industrial water or tap water. The cooling device 6 includes, as described later, a pump device (not shown), a coolant water supply pipe 63, the water jacket 61 (a primary cooling portion), and the cooling nozzles 62 (secondary cooling portions).

The pump device (not shown) is a power source configured to send the coolant water W to the cooling casting mold 5.

The coolant water supply pipe 63 is configured such that one end thereof is connected to the pump device and the other end thereof is connected to the water jacket 61 formed in the cooling casting mold 5.

<Water Jacket>

As illustrated in FIG. 1, the water jacket 61 is configured to cause the coolant water W sent from the coolant water supply pipe 63 to pass through a flow path formed in the cooling casting mold 5 at the periphery of the casting mold surface 5*a*, thereby cooling the molten metal 3 through the cooling casting mold 5. At a downstream end of the water jacket 61, the ejection ports 62*a* of the cooling nozzles 62 for releasing the coolant water W having passed through the water jacket 61 are formed. Thus, the water jacket 61 has a function as a flow path for causing the coolant water W for cooling the cooling casting mold 5 to flow and a function as a supply path for supplying the coolant water W to be ejected from the cooling nozzle 62.

Specifically, the water jacket 61 exchanges heat between the coolant water W and the cooling casting mold 5 to forcibly cool the cooling casting mold 5, thereby primarily cooling the molten metal 3 passing through the cooling casting mold 5 to form a solidified shell layer on a surface layer of the casting billet 4. The water jacket 61 is formed such that the flow path of the coolant water W meanders in the cooling casting mold 5. The water jacket 61 is configured such that a coolant water supply port 61*a* for supplying the coolant water W is formed on an upstream side of the water jacket 61 in the cooling casting mold 5 and the cooling nozzle 62 branching into multiple portions is formed on a downstream side. The flow rate of the coolant water W flowing in the water jacket 61 is set higher than the flow rate of a typical casting mold device for vigorously releasing the coolant water W straight to the casting billet 4 from the multiple elongated ejection ports 62*a*. For example, in the cooling device 6, the flow rate of the coolant water W is 0.2 m/s to 2.0 m/s. Moreover, the temperature of the coolant water W to be used is 20° C. to 35° C.

<Cooling Nozzle>

Figure 3A:
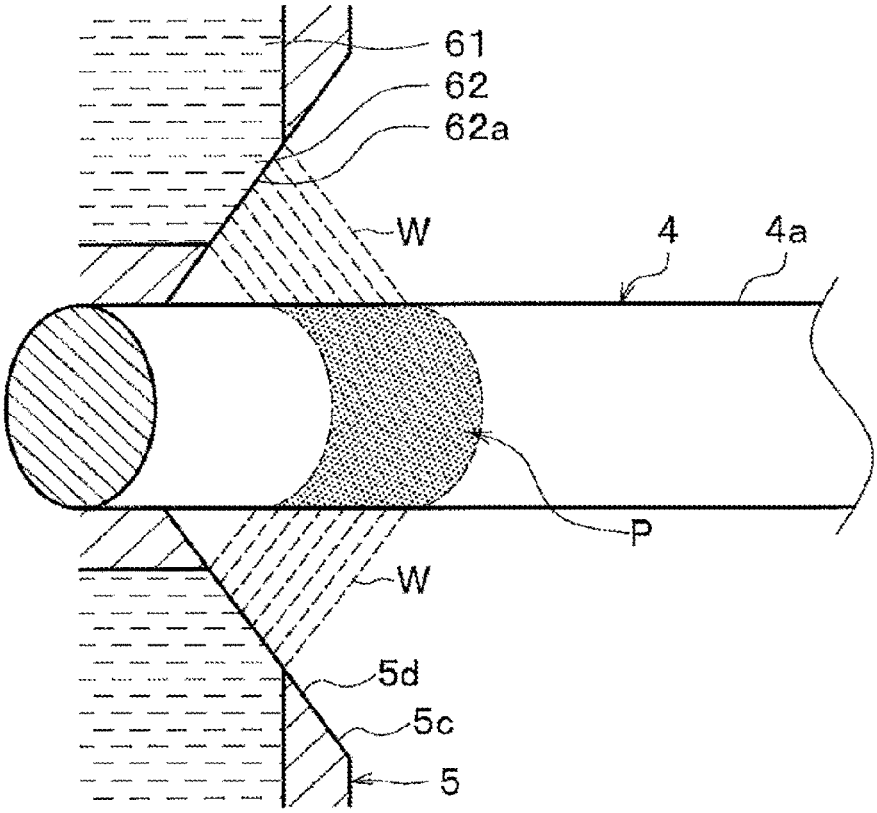
FIG. 3A is a schematic view of a coolant water collision area of the cooling nozzle.
Figure 3B:
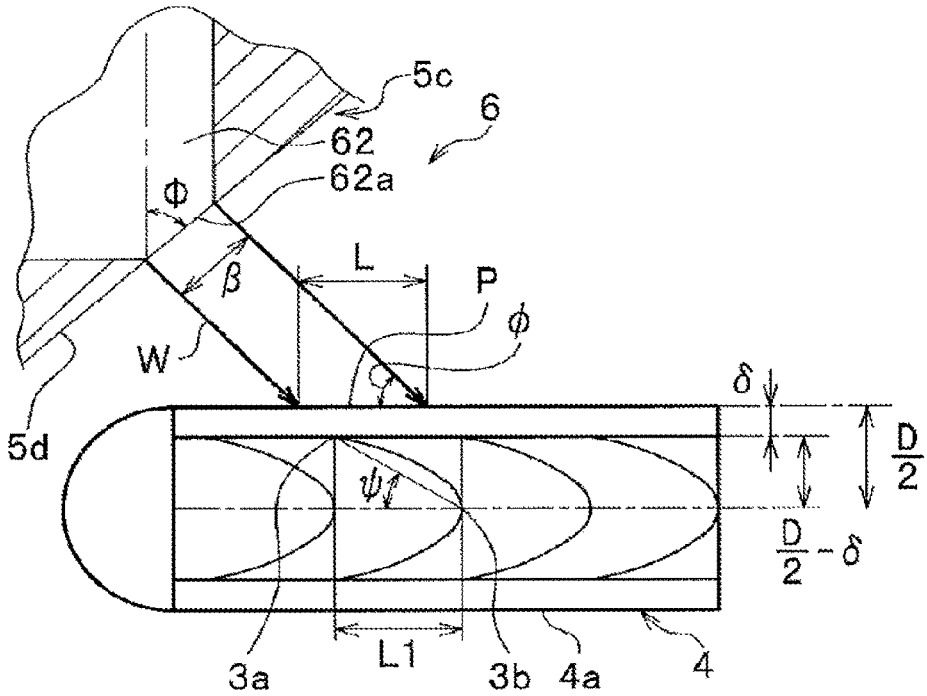
FIG. 3B is a schematic view illustrating a distance until completion of solidification after the start of solidification of an ingot forming a casting billet.

As illustrated in FIGS. 2, 3A, and 3B, the cooling nozzle 62 is a coolant water spray nozzle configured to release the coolant water W having passed through the water jacket 61 to a surface of the casting billet 4 pulled out of the cooling casting mold 5 to secondarily cool the casting billet 4. In other words, the cooling nozzle 62 is a nozzle configured to release the coolant water W used for primary cooling to the casting billet 4 right after pulled out of the cooling casting mold 5 through the multiple ejection ports 62*a*, thereby forcibly cooling the casting billet 4.

Figure 4A:
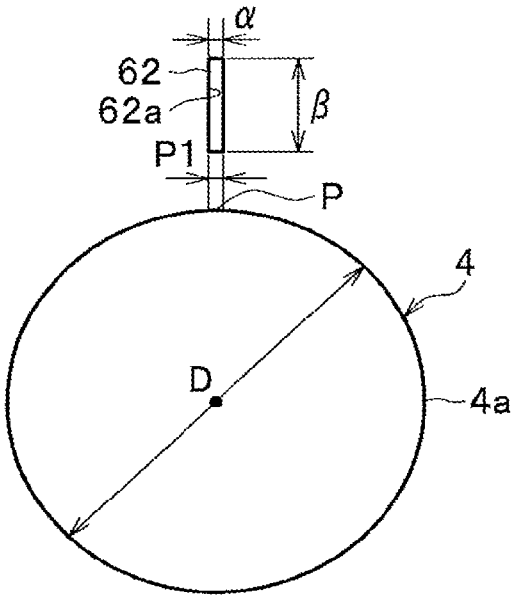
FIGS. 4A and 4B illustrate views of an arrangement relationship between an ejection port of the cooling nozzle and the casting billet, FIG. 4A being a view for describing a state in which a long side of the ejection port is arranged in a radial direction perpendicular to the axis of the casting billet and FIG. 4B being a view for describing a state in which the long side of the ejection port is arranged inclined with respect to the radial direction perpendicular to the axis of the casting billet.
Figure 4B:
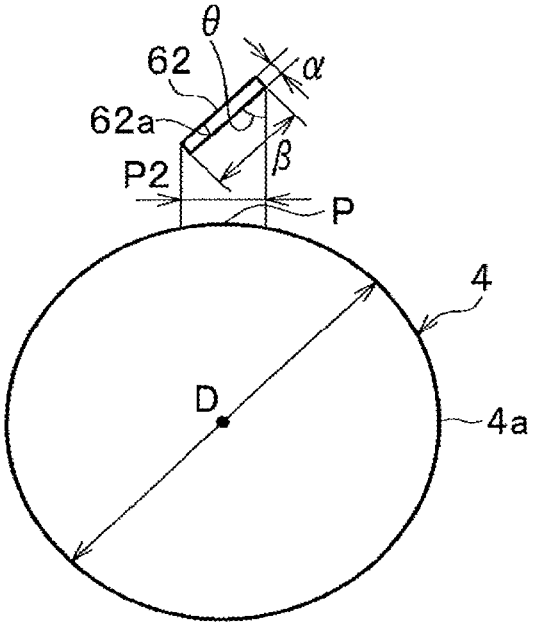

The multiple ejection ports 62*a* (see FIG. 1) of the cooling nozzles 62 are arranged in an annular shape at predetermined intervals at the inclined surface 5*d* in the circumferential direction. As illustrated in FIGS. 4A and 4B, the multiple ejection ports 62*a* are arranged along an outer circumferential direction of the surface of the casting billet 4, and each have short sides and long sides. The length $\beta$ of the long side of the ejection port 62*a* is formed longer than the length $\alpha$ of the short side of the ejection port 62*a*. The shape of the ejection port 62*a* is, for example, an elongated shape such as a rectangular shape, an elliptical shape, an oval shape, an egg shape, a trapezoidal shape, or a triangular shape. Although such a shape is preferably the rectangular shape, the shape is not limited to the rectangular shape.

Note that in a case where the shape of the ejection port 62*a* is the oval shape, the length $\alpha$ of the short side of the ejection port 62*a* is taken as the length of a short axis, and the length $\beta$ of the long side of the ejection port 62*a* is taken as the length of a long axis. Moreover, in a case where the shape of the ejection port 62*a* is the elliptical shape, the length $\beta$ of the long side of the ejection port 62*a* is taken as the length of the long axis, and the length $\alpha$ of the short side of the ejection port 62*a* is taken as the length of a center line perpendicular to the long axis. That is, the shape may be an elongated shape with a long side or axis.

As illustrated in FIG. 4A, at the ejection port 62*a* of the cooling nozzle 62, the direction of the long side of the ejection port 62*a* is, for example, arranged such that the inclination angle θ of the ejection port 62*a* with respect to the radial direction perpendicular to the axis of the casting billet 4 is 0 degree. That is, the long side or the long axis of the cooling nozzle 62 is arranged along the axis of the casting billet 4. In this case, the circumferential length P1 of a coolant water collision region P where the coolant water W released from the ejection port 62*a* contacts the casting billet 4 is short as in the length α of the short side of the ejection port 62*a*.

Figure 5:
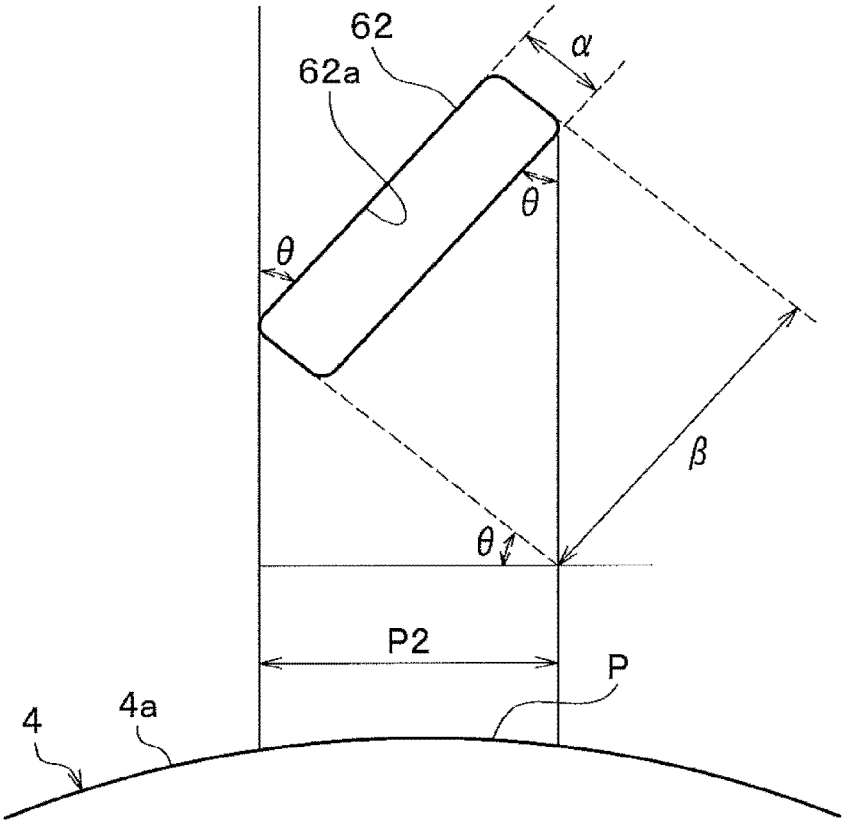
FIG. 5 is an enlarged schematic view of the ejection port of the cooling nozzle arranged inclined with respect to the radial direction perpendicular to the axis of the casting billet.

In a case where the circumferential length P1 of the coolant water collision region P is increased to further expand the coolant water collision region P, the inclination angle θ (hereinafter referred to as an "inclination angle θ of the ejection port 62*a*," as necessary) of the ejection port 62*a* with respect to the radial direction perpendicular to the axis of the casting billet 4 is, as illustrated in FIGS. 4B and 5, preferably set to 10 degrees to 50 degrees (preferably 15 degrees to 45 degrees).

Note that the inclination angle θ of the ejection port 62*a* with respect to the radial direction perpendicular to the axis of the casting billet 4 is set to 10 degrees to 50 degrees, and therefore, the coolant water W released from the rectangular ejection port 62*a* is diagonally released in the casting direction from the inside of the inclined surface 5*d* to the outer peripheral surface 4*a* of the casting billet 4.

In a case where the inclination angle θ of the ejection port 62*a* is set to a great angle, adjustment can be made such that the coolant water W released from the cooling nozzle 62 is released across a wide area in the outer circumferential direction of the outer peripheral surface 4*a* of the casting billet 4.

Moreover, in a case where the inclination angle θ of the ejection port 62*a* is set to a small angle, adjustment can be made such that the coolant water W released from the cooling nozzle 62 is released across a narrow area in the outer circumferential direction of the outer peripheral surface 4*a* of the casting billet 4.

The inclination angle θ of the ejection port 62*a* is set as described above so that the number N of ejection ports 62*a* formed in the opening 5*c* and the area of the coolant water collision region P in the circumferential direction can be adjusted.

As illustrated in FIGS. 3A and 3B, the coolant water collision region P is a region where the coolant water W released to gradually expand in upper-to-lower and right-to-left directions from the ejection port 62*a* of the cooling nozzle 62 collides with the outer peripheral surface 4*a* of the casting billet 4. The area of the coolant water collision region P can be adjusted in such a manner that the shape of the cooling nozzle 62 is changed as necessary. The ejection port 62*a* is formed such that the length β of the long side of the ejection port 62*a* is longer than the length α of the short side of the ejection port 62*a* along the casting direction, and is arranged inclined with respect to the casting billet 4 at the angle ϕ (hereinafter referred to as an "angle ϕ," as necessary) between the surface of the cooling nozzle 62 perpendicular to the casting direction and the inclined surface 5*d* (a nozzle surface). That is, the ejection ports 62*a* are formed at the inclined surface 5*d* at the angle ϕ, and therefore, the angle ϕ of the ejection port 62*a* is set. Moreover, the height of the ejection port 62*a* for releasing the coolant water W is formed to gradually increase in the casting direction with respect to the casting billet 4 due to the angle ϕ. Accordingly, time that the coolant water W contacts the outer peripheral surface 4*a* of the casting billets 4 is shifted between a base end side and a tip end side of the coolant water collision region P.

The angle ϕ of the cooling nozzle 62 is, for example, formed at 30 degrees. In a case where the angle of the cooling nozzle 62 is an angle greater than 30 degrees, a portion of the casting billet 4 too close to a casting mold surface 5*a* (see FIG. 2) side is cooled with the coolant water W of the cooling nozzle 62.

In a case where the angle ϕ of the cooling nozzle 62 is an angle smaller than 30 degrees, a portion of the casting billet 4 greatly apart from the ejection port 62*a* in the casting direction (the direction of an arrow a) is cooled with the coolant water W of the cooling nozzle 62.

The angle ϕ of the cooling nozzle 62 is adjusted as described above so that the length L of the coolant water collision region P in the casting direction can be adjusted.

As illustrated in FIGS. 4A and 4B, the ejection port 62*a* is formed such that the length α of the short side of the ejection port 62*a* is 0.1 mm to 5.0 mm (preferably about 0.1 mm). Moreover, the length β of the long side of the ejection port 62*a* is formed to be 2.5 mm to 20.0 mm (preferably about 5.0 mm to about 10.0 mm). As described above, the ejection port 62*a* is preferably formed in an elongated slit shape such that the length β of the long side of the ejection port 62*a* is equal to or greater than five times or ten times as long as the length α of the short side of the ejection port 62*a* (preferably 25 times to 200 times, and more preferably 50 times to 100 times). The multiple ejection ports 62*a* are provided at optional pitch intervals at the inclined surface 5*d* in a tapered shape (see FIG. 6).

As described above, many cooling nozzles 62 are configured such that the rectangular ejection ports 62*a* elongated in the casting direction are arranged in an annular shape at optional pitch intervals in the circumferential direction at an outer peripheral portion of the casting billet 4 to release the coolant water W to the coolant water collision region P across a wide area in the casting direction to cool the casting billet 4.

Note that a solidification angle ψ illustrated in FIG. 3B is the angle of a boundary between the molten metal 3 and the solidified ingot with respect to the center line of the casting billet 4, and is an angle between a line connecting a solidification start point 3*a* at which solidification of the molten metal 3 begins and a solidification end point 3*b* at which solidification is completed and the center line of the casting billet 4. In a case where a distance L1 from the solidification start point 3*a* at the start of solidification of the ingot to the solidification end point 3*b* upon completion of solidification is long and the solidification angle ψ is an acute angle, internal stress is high, and cracks are easily caused. The distance L1 until completion of solidification after the start of solidification of the ingot and the solidification angle ψ are preferably set to values leading to less cracks. For this reason, the ejection port 62*a* of the cooling nozzle 62 is set such that the distance L1 until completion of solidification after the start of solidification of the ingot forming the casting billet 4 cooled with the coolant water W released from the ejection port 62*a* satisfies Expression (1) below. In this case, the thickness δ of the solidified shell layer is about 10 mm. The solidification angle ψ is preferably equal to or greater than 35 degrees from previous experience. That is, in Expression (1), L1 represents the distance (mm) until completion of solidification after the start of solidification of the ingot, D represents the diameter (mm) of the casting billet 4, 6 represents the thickness (mm) of the solidified shell layer of the casting billet 4, and ψ represents the solidification angle (degrees) of the casting billet 4. For the distance L1 until completion of solidification after the start of solidification of the ingot in Expression (1), the solidification angle ψ is preferably set to equal to or greater than 35 degrees.

[Expression 1]

$$L1 = \frac{\left(\frac{D}{2} - \delta\right)}{\tan\psi} \quad \text{Expression (1)}$$

Moreover, the cooling nozzle 62 is configured such that the distance L of the coolant water collision region P, where the coolant water W released from the ejection port 62*a* contacts the casting billet 4, in the casting direction is increased and the length β of the long side of the ejection port 62*a* is set longer for improving a cooling efficiency and preventing the cracks. Thus, the ejection port 62*a* of the cooling nozzle 62 is set such that the length β of the long side of the ejection port 62*a* satisfies Expression (2). Note that in the case of measuring the thickness δ of the solidified shell layer of the casting billet 4 and the solidification angle ψ, the continuously-casted casting billet 4 (ingot) is cut in half along the center line by a billet cutting machine, a cut surface is polished, and etching is performed for a polished surface. Thereafter, a pool shape of the solidified molten metal 3 is directly measured.

[Expression 2]

$$\beta \geq L1 \times \sin\phi \quad \text{Expression (2)}$$

Note that in Expression (2), β represents the length (mm) of the long side of the ejection port 62*a*, L1 represents the distance (mm) until completion of solidification after the start of solidification of the ingot, and ϕ represents the angle (degrees) of the cooling nozzle 62 with respect to the casting direction. That is, the ejection port 62*a* is preferably formed in the elongated slit shape at the inclined surface 5*d*, and is preferably set such that the coolant water W is diagonally released to the outer peripheral surface 4*a* of the casting billet 4 in the casting direction at the angle ϕ. Note that for improving the cooling efficiency of the cooling nozzle 62, the length β of the long side of the ejection port 62*a* of the cooling nozzle 62 is preferably set such that the distance L of the coolant water collision region P in the casting direction with respect to the distance L1 until completion of solidification after the start of solidification of the ingot satisfies $$L1 \leq L.$$

As illustrated in FIGS. 4A and 4B, the ejection port 62*a* of the cooling nozzle 62 is preferably set such that a coverage ratio C defined by Expression (3) is 60% to 100% as in Expression (4) below.

[Expression 3]

$$C = \frac{N \times (\cos\theta \times (\alpha + \beta \times \tan\theta))}{D \times \pi} \times 100 \quad \text{Expression (3)}$$

[Expression 4]

-continued $$60 \leq C \leq 100 \quad \text{Expression (4)}$$

Note that in Expression (3) and Expression (4), C represents the coverage ratio (%), N represents the number (ports) of ejection ports 62*a* of the cooling nozzles 62, θ epresents the inclination angle (degrees) of the ejection port 62*a* of the cooling nozzle 62 with respect to the radial direction perpendicular to the axis of the casting billet 4, a represents the length (mm) of the short side of the ejection port 62*a* of the cooling nozzle 62, β represents the length (mm) of the long side of the ejection port 62*a* of the cooling nozzle 62, D represents the diameter (mm) of the casting billet 4, and π represents a circle ratio. That is, the coverage ratio C is the percentage (%) of the length of the coolant water collision region P in the circumferential direction with respect to the length (πD) of the outer periphery of the casting billet 4 in the circumferential direction. The coverage ratio C is 60% to 100%, and is set to be higher than 60% and not to exceed 100%. With this configuration, the coolant water W released from the ejection ports 62*a* adjacent to each other in the circumferential direction can be released not to overlap with each other on the outer peripheral surface 4*a* of the casting billet 4, thereby efficiently cooling the casting billet 4. Moreover, the multiple ejection ports 62*a* are preferably arranged inclined to release the coolant water W across a wide area in the circumferential direction of the outer peripheral surface 4*a* of the casting billet 4.

«Delivery Device»

As illustrated in FIG. 1, the delivery device 8 is a device configured to deliver the casting billets 4 casted by the cooling casting molds 5. The delivery device 8 includes, for example, multiple rollers 81 to be rotated by a motor (not shown). The multiple rollers 81 are arranged and laid below the casting billets 4 along the casting direction for sending the casting billets 4 from a lower side of the vicinity of the openings 5*c* of the cooling casting molds 5.

«Advantageous Effects»

Next, advantageous effects of the continuous casting mold, the continuous casting device, and the continuous casting method according to the embodiment of the present invention will be described.

As illustrated in FIGS. 1 and 2, in a case where the casting billets 4 are continuously casted by the continuous casting device 1, the molten metal 3 in the tundish 2 is first slowly supplied into the casting mold surfaces 5*a* of the cooling casting molds 5 through the molten metal supply ports 5*b*. The water jacket 61 is provided inside the cooling casting mold 5 outside the casting mold surface 5*a*, and therefore, the coolant water W flowing in the water jacket 61 and the cooling casting mold 5 heated by the molten metal 3 exchange heat to cool the cooling casting mold 5. In this case, the coolant water W flowing in the water jacket 61 is, for the sake of convenience in releasing the coolant water W from the cooling nozzles 62 having the many rectangular ejection ports 62*a*, set to a higher flow rate, a greater water amount, and a higher water pressure as compared to a typical cooling casting mold including a cooling device having a non-rectangular ejection port.

Thus, the water jacket 61 can prevent occurrence of a phenomenon so-called sweating and break-out that the molten metal 3 flows out of the casting mold surface 5*a* even when a cooling capacity is higher as compared to a typical circulation type water jacket and the casting speed V is higher than a casting speed upon continuous casting by a typical cooling casting mold. The molten metal 3 sent into the cooling casting mold 5 cooled by the water jacket 61 comes into contact with the casting mold surface 5*a*, and therefore, is primarily cooled from the solidification start point 3*a* to a secondary cooling start point 3*c* as illustrated in FIG. 2. Thus, the solidified shell layer is formed on the surface layer of the molten metal 3, and is solidified in the shape of a round billet (the casting billet 4). The casting speed V at this point exceeds 500 mm/min.

<Case where Inclination Angle θ of Ejection Port with Respect to Radial Direction Perpendicular to Axis of Casting Billet is 0 Degree>

As illustrated in FIG. 4A, in a case where the ejection port 62*a* of the cooling nozzle 62 is formed in the radial direction perpendicular to the axis of the casting billet 4, the inclination angle θ of the ejection port 62*a* with respect to the radial direction perpendicular to the axis of the casting billet 4 is 0 degree. In this case, the coolant water W released from the rectangular ejection port 62*a* having the short side and the long side is, as illustrated in FIG. 1, released from the many ejection ports 62*a* arranged at optional intervals in the circumferential direction to the outer peripheral surface 4*a* of the casting billet 4 such that the shape of the coolant water collision region P is in a rectangular shape elongated in the casting direction as in the shape of the ejection port 62*a*.

As illustrated in FIG. 3B, the angle ϕ between the surface of the cooling nozzle 62 perpendicular to the casting direction and the inclined surface 5*d* is, for example, formed at 30 degrees. With the angle of the cooling nozzle 62, interference with advancement of the coolant water W due to splashing of the coolant water W collided with the ingot is prevented for the coolant water W released from each ejection port 62*a*, and cooling of a wider area than that of the typical technique is allowed. Thus, the ingot can be efficiently cooled. In this case, the solidification speed of the casting billet 4 (the ingot) is increased, and time required until completion of solidification after the start of solidification is shortened. Thus, the distance L1 until completion of the solidification after the start of solidification is shortened, and the solidification angle ψ is the obtuse angle. Specifically, time required until the solidification end point 3*b* at which solidification is completed after the secondary cooling start point 3*c* (see FIG. 2) of the molten metal 3 is shortened, and the ingot is rapidly cooled.

Generally, in a case where the casting speed V is high, the distance L1 until completion of solidification of a center portion of the ingot after the start of solidification increases, and therefore, the solidification angle ψ inside the ingot is the acute angle. Thus, in a typical case, when the ingot center portion is solidified, internal stress received due to solidification and contraction caused in the outer circumferential direction increases, and for this reason, the cracks are caused at the casting billet 4. In this case, a greater solidification angle ψ results in less occurrence of the cracks, and a longer distance L1 until completion of solidification of the center portion of the ingot after the start of solidification results in more occurrence of the cracks.

As described above, in the present invention, the shape of the ejection port 62*a* is the rectangular shape having the short side and the long side, and the multiple ejection ports 62*a* are provided. Thus, the distance L of the coolant water collision region P in the casting direction increases, and therefore, a wide area can be forcibly cooled. The time required until completion of solidification after the start of solidification is shortened, and therefore, the solidification angle ψ can be the obtuse angle.

As a result, even in a case where high-speed casting in which the casting speed V exceeds 500 mm/min is performed, the cooling capacity is high, and an optimal cooling region where no cracks are caused at the casting billet 4 can be cooled. Thus, occurrence of the cracks at the casting billet 4 can be reduced.

Figure 7A:
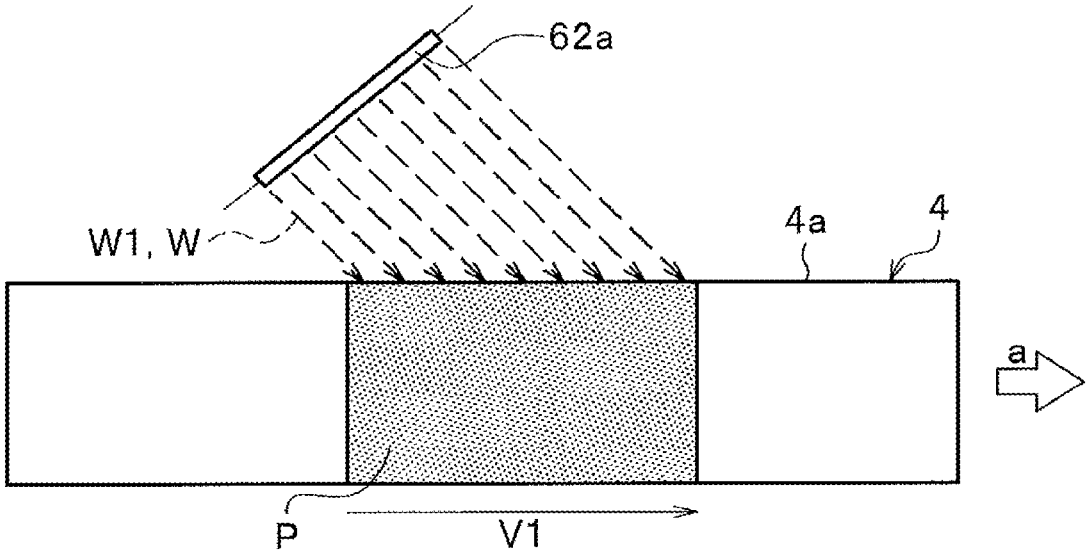
FIG. 7A to 7C illustrate views of a relationship between the state of coolant water released to an outer peripheral surface of the casting billet from the ejection port of the cooling nozzle and a solidification speed, FIG. 7A being a view for describing a case where the long side of the ejection port is arranged in the radial direction perpendicular to the axis of the casting billet, FIG. 7B being a view for describing a case where the long side of the ejection port is arranged inclined with respect to the radial direction perpendicular to the axis of the casting billet, and FIG. 7C being a view for describing the case of a typical example where cooling is performed by a secondary cooling nozzle and a tertiary cooling nozzle.

Next, a reason why the cooling speed of the casting billet 4 (the ingot) can be, with reference to FIGS. 7A and 7C, increased will be described using a typical example (a horizontal continuous casting device described in JP2011-131245A).

Figure 7B:
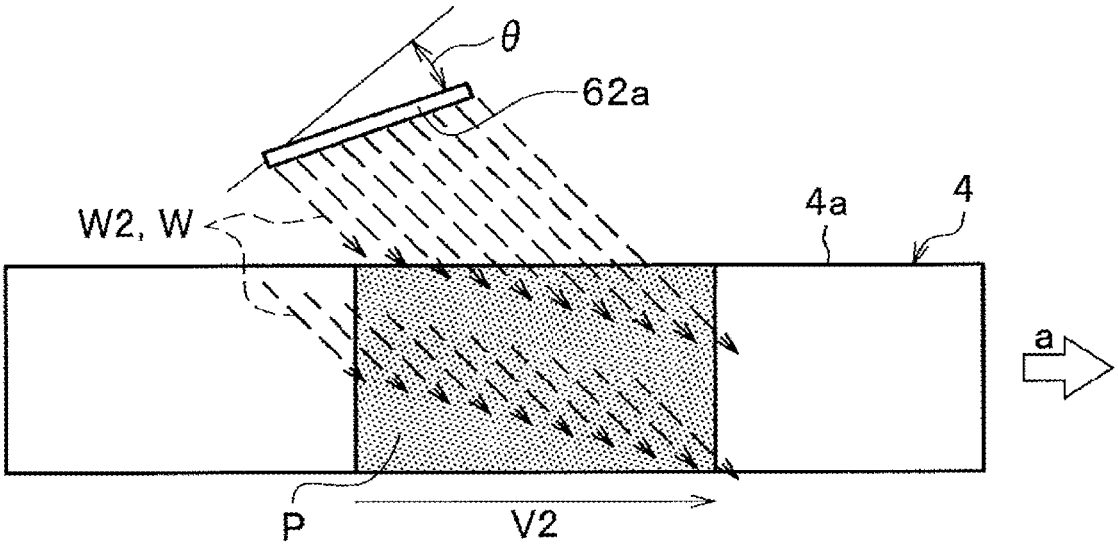
Figure 7C:
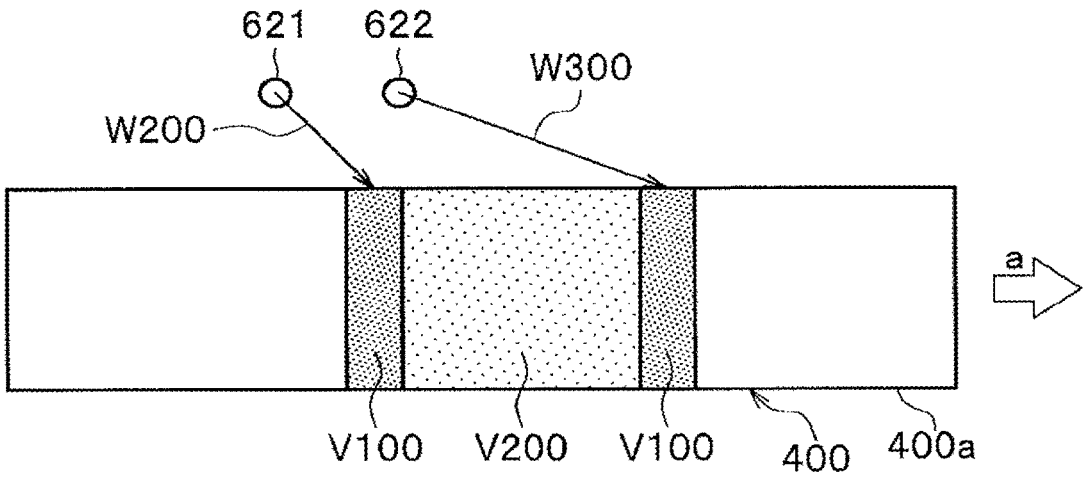

As illustrated in FIG. 7C, in a cooling casting mold of the typical example, ejection ports of a secondary cooling nozzle 621 and a tertiary cooling nozzle 622 are formed to have the same longitudinal/lateral length, and are arranged on a concentric circle of a cylindrical opening surface. Thus, positions at which secondary coolant water W200 and tertiary coolant water W300 released from the secondary cooling nozzle 621 and the tertiary cooling nozzle 622 collide with a casting billet 400 are two spots separated from each other in a casting direction, and the secondary coolant water W200 and the tertiary coolant water W300 collide with an outer peripheral surface 400*a* of the casting billet 400 in an annular shape.

The solidification speed of the casting billet 400 in this case is highest at the positions collided with the secondary coolant water W200 and the tertiary coolant water W300, and is lower between the position collided with the secondary coolant water W200 and the position collided with the tertiary coolant water W300.

Thus, in the horizontal continuous casting device as described in JP2011-131245A, there is a probability that cracks are caused in a case where a casting speed exceeds 500 mm/min.

Note that for improving the solidification speed of a center portion of an ingot for the purpose of preventing occurrence of these cracks, it is effective that an interval between the positions collided with the secondary coolant water W200 and the tertiary coolant water W300 is decreased to decrease an area where the solidification speed is lower as much as possible and a high cooling effect is maintained in an area until complete solidification of the ingot.

For satisfying these conditions, the coolant water ejection port needs to be expanded, and the shape of the ejection port, the number of ejection ports, the inclination angle of the ejection port, etc. need to be designed and determined such that the coolant water constantly collides with the ingot across a wide area.

On the other hand, the cooling nozzle 62 of the present invention has, in the casting direction (the direction of the arrow a), the rectangular ejection port 62*a* configured such that the length β of the long side of the ejection port 62*a* is longer than the length α of the short side. Thus, as illustrated in FIG. 7A, the distance L of the coolant water collision region P, where the coolant water W released from the ejection ports 62*a* collides with the outer peripheral surface 4*a* of the casting billet 4, in the casting direction is long, and the coolant water W continuously contacts a wide area in the casting direction in a shower shape. As a result, even when a casting speed V1 across the entirety of the coolant water collision region P is increased to the speed exceeding 500 mm/min, occurrence of the cracks at the casting billet 4 can be reduced.

<Case where Inclination Angle θ of Ejection Port with Respect to Radial Direction Perpendicular to Axis of Casting Billet is Inclined Beyond 0 Degree>

Figure 6:
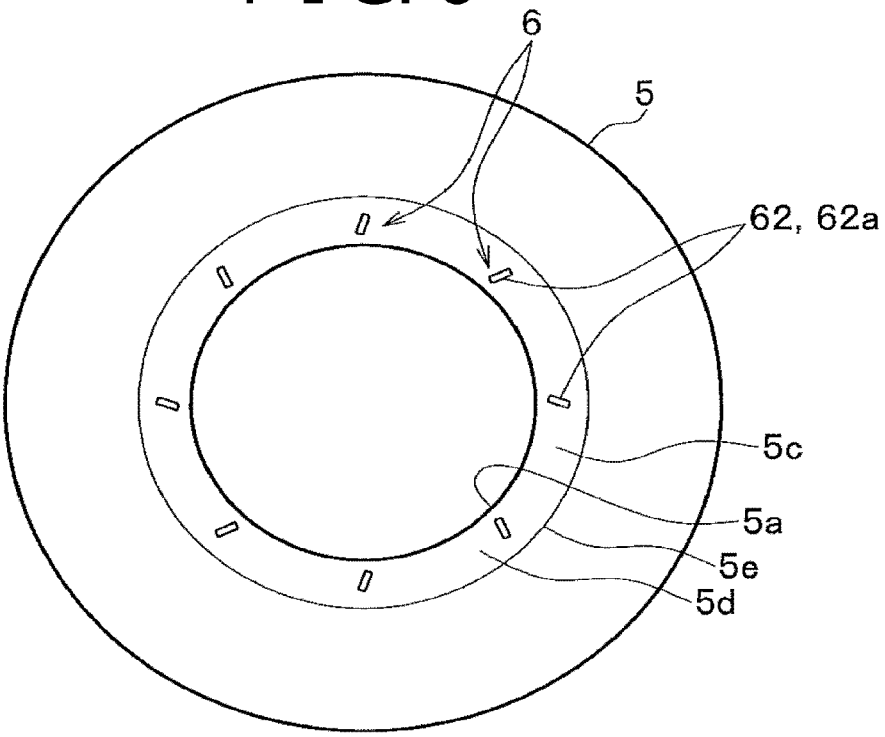
FIG. 6 is an enlarged schematic front view of a main portion illustrating one example of the cooling casting mold when the ejection port of the cooling nozzle is arranged inclined with respect to the radial direction perpendicular to the axis of the casting billet.
Figure 8:
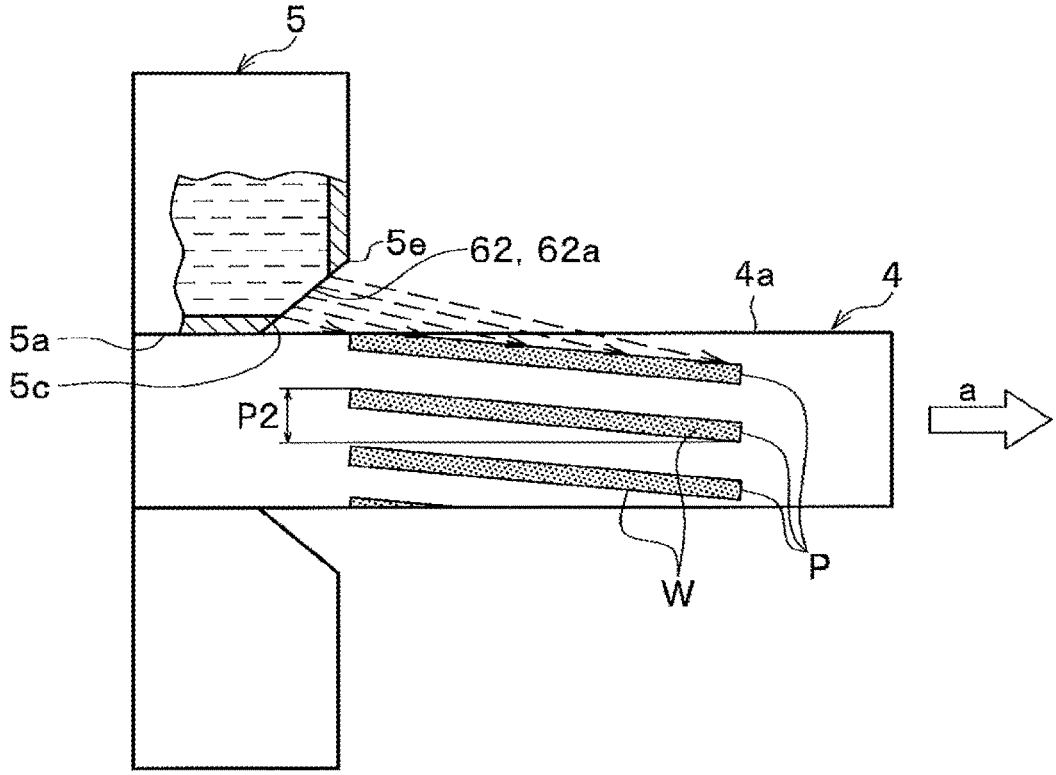
FIG. 8 is an enlarged schematic longitudinal sectional view of a main portion illustrating the state of the coolant water released from the ejection port in a case where the long side of the ejection port of the cooling nozzle is arranged inclined with respect to the radial direction perpendicular to the axis of the casting billet.
Figure 9:
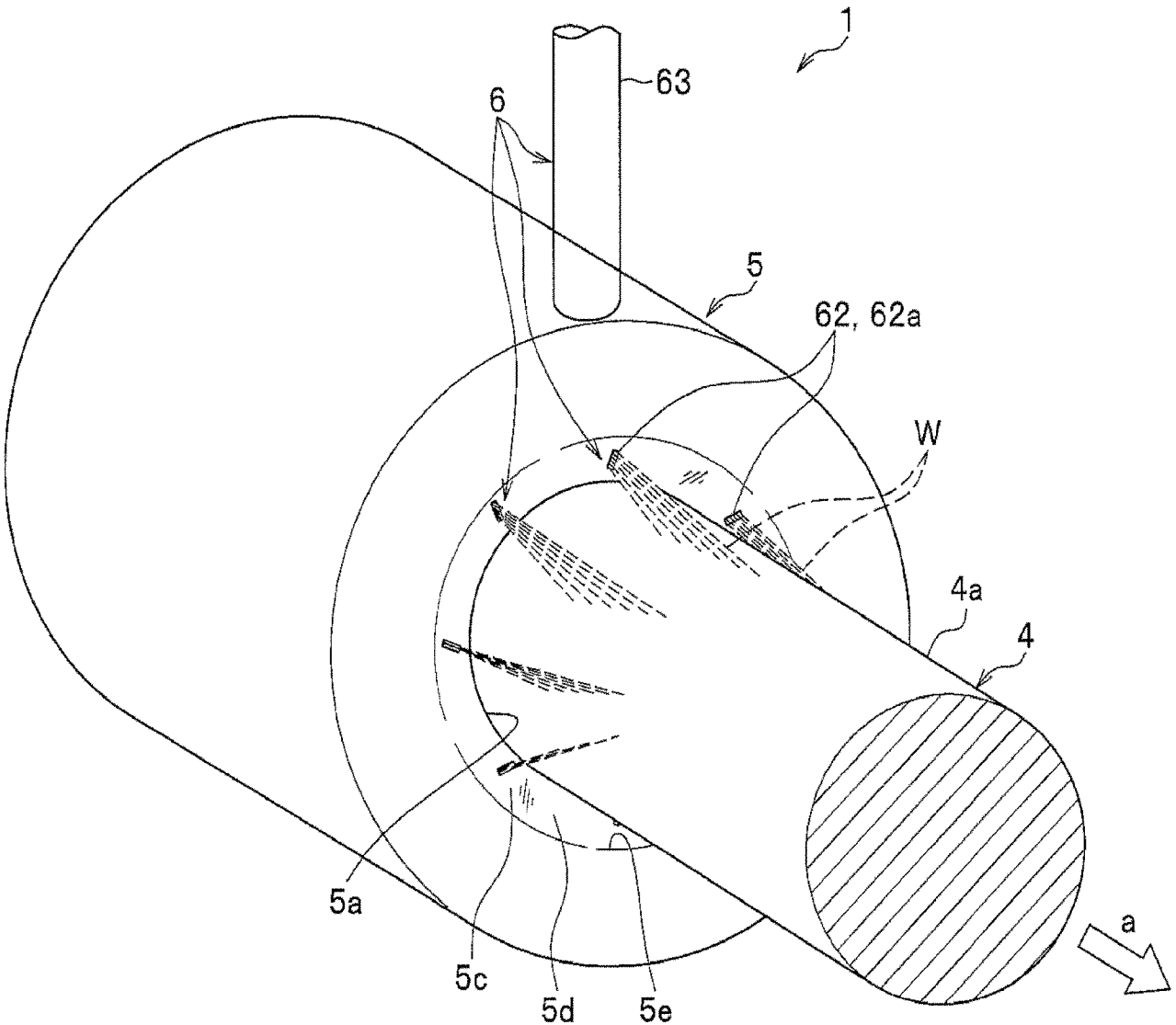
FIG. 9 is an enlarged schematic perspective view of a main portion illustrating one example of an arrangement state of the ejection port of the cooling nozzle in the cooling casting mold.

As illustrated in FIGS. 4B, 5, and 6, the cooling nozzle 62 is formed such that the rectangular ejection port 62*a* having the short side and the long side is inclined at the inclination angle θ with respect to the radial direction perpendicular to the axis of the casting billet 4. As described above, in the case of inclination at the inclination angle θ of the ejection port 62*a* with respect to the radial direction perpendicular to the axis of the casting billet 4, the coolant water W released from the ejection ports 62*a* is, as illustrated in FIGS. 7B, 8, and 9, diagonally released in the casting direction from the many ejection ports 62*a* arranged at optional intervals in the circumferential direction to the outer peripheral surface 4*a* of the casting billet 4.

Thus, as illustrated in FIG. 7B, the coolant water W released from each ejection port 62*a* is diagonally released in the casting direction to the outer peripheral surface 4*a* of the casting billet 4 pulled and moved in the casting direction. As compared to a case where the above-described inclination angle θ of the ejection port 62*a* is 0 degree, the coolant water collision region P where the coolant water W collides with the outer peripheral surface 4*a* of the casting billet 4 is, as illustrated in FIG. 8, longer and wider by an increase in the distance P2 of the coolant water collision region P in the outer circumferential direction. Further, the coolant water W contacts a wide area in the shower shape, and therefore, the cooling capacity can be improved and the casting billet 4 can be efficiently secondarily cooled. By such secondary cooling, the molten metal 3 in a molten state in the casting billet 4 is forcibly cooled and solidified to a core.

As a result, even when the casting speed V is the high speed exceeding 500 mm/min, the solidification speed of the casting billet 4 (the ingot) is high, and the time required until completion of solidification after the start of solidification is shortened. Thus, the solidification angle ψ (see FIG. 3B) can be the obtuse angle. Thus, occurrence of the cracks at the casting billet 4 can be reduced. Consequently, even when continuous casting is performed at the casting speed V as the speed exceeding 500 mm/min, the continuous casting device 1 can cast the casting billets 4 with no cracks.

The casting billet 4 forcibly cooled by the cooling nozzles 62 is further pulled by the delivery device 8 (see FIG. 1), and is delivered in the casting direction.

As described above, in the continuous casting device 1 according to the embodiment of the present invention, the molten metal 3 is primarily cooled by the water jacket 61, and is secondarily cooled across a wide area of the long coolant water collision region P with the coolant water W released from the rectangular ejection ports 62*a* of the cooling nozzles 62 having the short side and the long side. Thus, the cooling capacity of the cooling device 6 can be improved. Thus, even when the casting speed V is the high speed exceeding 500 mm/min, the cracks are less caused, the favorable-quality casting billets 4 can be continuously casted at high speed, many casting billets 4 can be produced within a short period of time. Thus, a cost can be reduced. Moreover, in a case where continuous casting is performed at a casting speed V of equal to or lower than 500 mm/min, the continuous casting device 1 has a higher cooling capacity as compared to the continuous casting device described in JP2011-131245A, and therefore, the cooling speed is higher. Consequently, miniaturization of a crystallized product is expected.

[Variations]

Note that the present invention is not limited to the above-described embodiment, and various modifications and changes can be made within the scope of the technical idea of the present invention. Needless to say, the present invention also includes these modifications and changes. Note that the same reference numerals are used to represent the already-described configurations, and description thereof will be omitted.

Figure 10A:
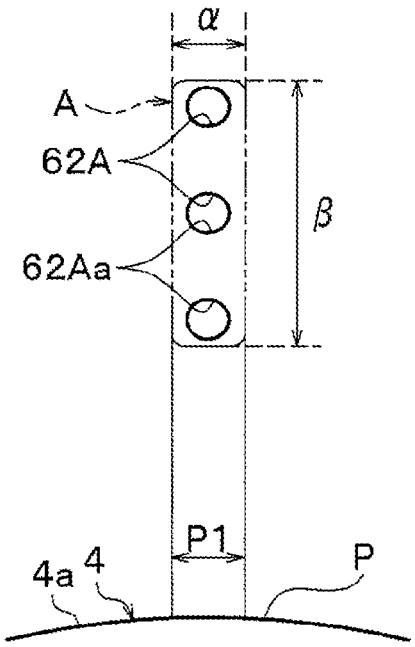
FIG. 10A to 10D illustrates views of variations of the continuous casting device according to the embodiment of the present invention, FIG. 10A being a view for describing a state in a case where multiple ejection ports are arranged in an ejection port area, FIG. 10B being a view for describing a state in a case where many ejection ports are arranged in an ejection port area, FIG. 10C being a view for describing a state in a case where quadrangular ejection ports are arranged in an ejection port area, and FIG. 10D being a view for describing a state in a case where a long side of an ejection port area is arranged inclined with respect to a radial direction perpendicular to the axis of a casting billet.
Figure 10B:
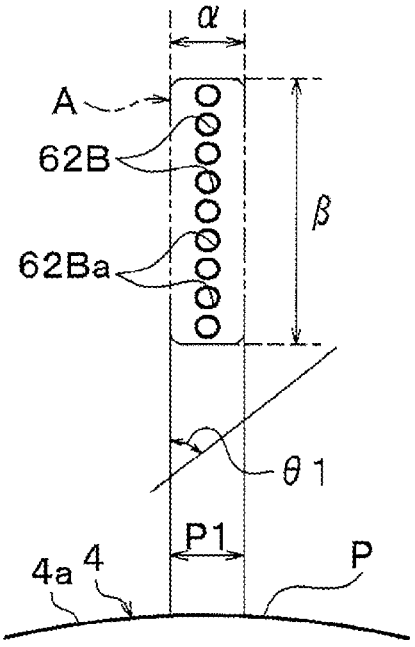
Figure 10C:
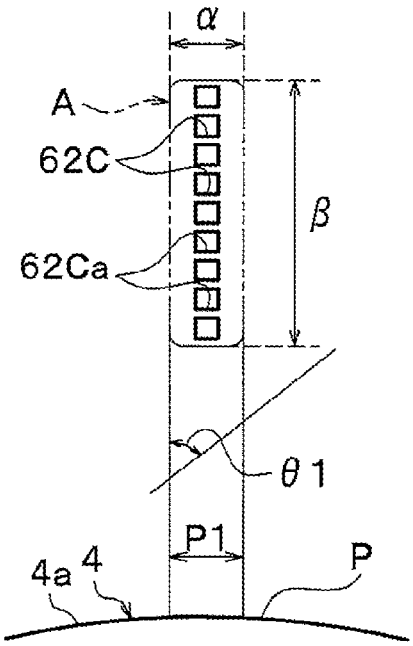
Figure 10D:
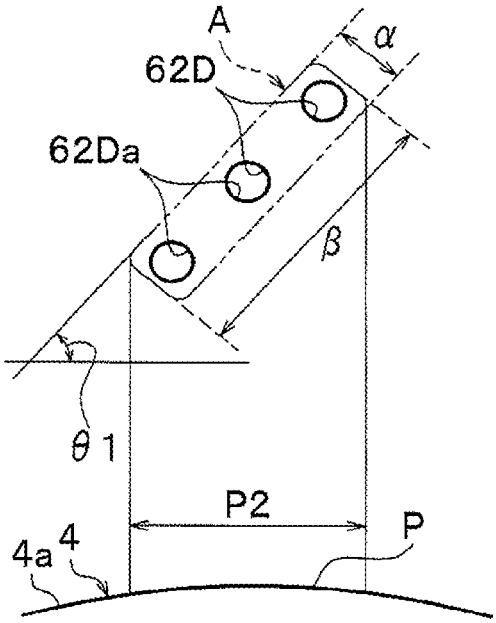

FIG. 10A to 10D illustrate variations of the continuous casting device according to the embodiment of the present invention, FIG. 10A being a view for describing a state in a case where multiple ejection ports are arranged in an ejection port area, FIG. 10B being a view for describing a state in a case where many ejection ports are arranged in an ejection port area, FIG. 10C being a view for describing a state in a case where quadrangular ejection ports are arranged in an ejection port area, and FIG. 10D being a view for describing a state in a case where a long side of an ejection port area is arranged inclined with respect to a radial direction perpendicular to the axis of a casting billet.

In the above-described embodiment, the case of the multiple rectangular ejection ports 62*a* arranged along the outer circumferential direction of the surface of the casting billet 4 and having the short side α and the long side β as illustrated in FIGS. 4A and 4B has been described as one example of the cooling nozzle 62, but the present invention is not limited to above.

For example, as illustrated in FIG. 10A, cooling nozzles 62A may be configured such that multiple ejection ports 62Aa are arranged along the direction of a long side in an ejection port area A having a short side α and a long side β and multiple ejection port areas A are arranged along an outer circumferential direction of a surface of a casting billet 4. In this case, the ejection ports 62Aa are arranged at optional intervals at multiple spots including one end portion and the other end portion of the rectangular ejection port area A in a longitudinal direction thereof. Moreover, the long side of the ejection port area A is arranged along the axis of the casting billet 4.

Substantially similarly to the ejection port 62*a* (see FIG. 4A) of the embodiment, the ejection port area A is formed to have a short side length α of 0.1 mm to 5.0 mm (preferably about 0.1 mm), and is formed to have a long side length β of 2.5 mm to 20.0 mm (preferably about 5.0 mm to about 10.0 mm). As described above, the ejection port area A is formed in an elongated slit shape.

Moreover, as illustrated in FIG. 10B, two or more ejection ports 62Ba of cooling nozzles 62B may be arranged in a longitudinal direction at optional intervals in a rectangular ejection port area A. In this case, the shape of a coolant water collision region P where coolant water W released from the ejection ports 62Ba contacts a casting billet 4 is, as in the case of the ejection port 62*a*, preferably such a shape that the coolant water W continuously contacts the casting billet 4 in a casting direction, and the coolant water W is preferably released in a rectangular shape elongated in the casting direction.

Further, the shapes of the ejection ports 62Aa, 62Ba (see FIGS. 10A and 10B) are not limited to a circular shape. As illustrated in FIG. 10C, the shape of an ejection port 62Ca may be a quadrangular shape such as a square shape or a rectangular shape. In addition, the shape of the ejection port 62Ca may be, for example, a square shape, an elliptical shape, an oval shape, an egg shape, a trapezoidal shape, or a triangular shape.

In addition, as illustrated in FIG. 10D, a rectangular ejection port area A where multiple ejection ports 62Da are arranged may be, as in the ejection port 62*a* (see FIG. 4B) of the embodiment, arranged inclined at an angle θ1 with respect to the radial direction perpendicular to the axis of the casting billet 4. Needless to say, the ejection port areas A illustrated in FIGS. 10B and 10C may be similarly arranged inclined at the angle θ1.

[Other Variations]

Moreover, as long as the cooling casting mold 5 illustrated in FIG. 2 has the casting mold surface 5*a*, the molten metal supply port 5*b*, the opening 5*c*, the inclined surface 5*d*, the water jacket 61, and the cooling nozzles 62, the structure, shape, etc. of the cooling casting mold 5 may be changed as necessary. For example, the cooling casting mold 5 may be integrally assembled from a heat insulating material forming the molten metal supply port 5*b* and multiple members made of highly-heat-conductive steel or copper alloy forming the casting mold surface 5*a*, the opening 5*c*, the water jacket 61, and the cooling nozzles 62.

Further, in the above-described embodiment and examples, the case where the angle ϕ between the surface of the cooling nozzle 62 perpendicular to the casting direction and the inclined surface 5*d* as illustrated in FIG. 3B is 30 degrees has been described by way of example, but as necessary, the angle ϕ may be changed to other angles than 30 degrees. For example, the angle ϕ of the cooling nozzle 62 may be, as necessary, changed to 15 degrees to 75 degrees according to the inclination angle θ of the ejection port 62*a* with respect to the radial direction perpendicular to the axis of the casting billet 4.

In addition, as the inclination angle θ of the ejection port 62*a* with respect to the radial direction perpendicular to the axis of the casting billet 4 increases, the length P2 of the coolant water collision region P in the outer circumferential direction increases, and therefore, the coolant water collision region P can be expanded. Thus, the angle of the cooling nozzle 62 may be increased by expansion of the coolant water collision region P by an increase in the inclination angle θ, and in this manner, the distance L of the coolant water collision region P in the casting direction may be decreased.

Moreover, the angle ϕ of each of the multiple ejection ports 62*a* of the cooling nozzles 62 arranged in the annular shape in the circumferential direction is not necessarily the same among all ejection ports 62*a*. For example, the angle ϕ of the ejection port 62*a* may be different between the ejection ports 62*a* adjacent to each other in the circumferential direction.

Further, the shape of the ejection port 62*a* of the cooling nozzle 62 may be changed as necessary in such a manner that a frame-shaped member is detachably provided at the opening 5*c* of the ejection port 62*a* of the cooling nozzle 62.

As illustrated in FIG. 2, the case where the cooling device 6 is configured such that the coolant water W used in the water jacket 61 as the primary cooling portion is used in the cooling nozzle 62 as the secondary cooling portion has been described, but the present invention is not limited to above. For example, the coolant water W supplied to the water jacket 61 and the cooling nozzle 62 may be one supplied from coolant water supply devices of different systems.

What is claimed is:

1. A continuous casting mold for continuously casting a casting billet while cooling molten metal by a cooling device provided at a cooling casting mold, wherein the cooling device includes multiple cooling nozzles configured to release coolant water to the casting billet pulled out of the cooling casting mold to cool the casting billet, multiple ejection ports of the multiple cooling nozzles are arranged along an outer circumferential direction of a surface of the casting billet, and each ejection port has a short side and a long side, a short axis and a long axis, or a long axis and a center line crossing the long axis, is formed in a shape elongated in a long side direction or a long axis direction, and is configured such that the long side or the long axis is arranged along an axial direction of the casting billet, wherein each ejection port of the cooling nozzles is formed in a rectangular shape, a distance L1 until completion of solidification after a start of solidification of an ingot forming the casting billet cooled with the coolant water released from each ejection port is set to satisfy Expression (1) below, and a length β of the long side of each ejection port is set to satisfy Expression (2) below:

$$L1 = \frac{\left(\frac{D}{2} - \delta\right)}{\tan\psi} \qquad \text{[Expression 1]}$$

[Expression 2] β≥L1×sin φ where in Expressions (1) and (2), L1 represents the distance (mm) until completion of solidification after the start of solidification of the ingot, D represents a diameter (mm) of the casting billet, δ represents a thickness (mm) of a solidified shell layer of the casting billet, ψ represents a solidification angle (degrees) of a boundary between the molten metal and the solidified ingot with respect to a center line of the casting billet, β represents the length (mm) of the long side of each ejection port, and φ represents an angle (degrees) between a surface of each cooling nozzle perpendicular to a casting direction and an inclined surface.

2. The continuous casting mold according to claim 1, wherein each ejection port of the cooling nozzles is formed to have an ejection port short side length of 0.1 mm to 5.0 mm.

3. The continuous casting mold according to claim 2, wherein a coverage ratio C defined by Expression (3) below is set to 60% to 100% as in Expression (4):

[Expression 3]

$$C = \frac{N \times (\cos\theta \times (\alpha + \beta \times \tan\theta))}{D \times \pi} \times 100 \qquad \text{Expression (3)}$$

[Expression 4]

$$60 \le C \le 100 \qquad \text{Expression (4)}$$

where in Expressions (3) and (4),

C represents the coverage ratio (%),

N represents the number (ports) of ejection ports of the cooling nozzles,

θ represents an inclination angle (degrees) of each ejection port of the cooling nozzles with respect to a radial direction perpendicular to an axis of the casting billet, α represents a length (mm) of the short side of each ejection port of the cooling nozzles, β represents a length (mm) of the long side of each ejection port of the cooling nozzles, D represents a diameter (mm) of the casting billet, and π represents a circle ratio.

4. The continuous casting mold according to claim 1, wherein each ejection port of the cooling nozzles is formed to have an ejection port long side length of 2.5 mm to 20.0 mm, and a ratio between the short side and the long side is five times or more.

5. The continuous casting mold according to claim 1, wherein each ejection port of the cooling nozzles is arranged inclined with respect to a radial direction perpendicular to an axis of the casting billet.

6. The continuous casting mold according to claim 1, wherein a coverage ratio C defined by Expression (3) below is set to 60% to 100% as in Expression (4):

[Expression 3]

$$C = \frac{N \times (\cos\theta \times (\alpha + \beta \times \tan\theta))}{D \times \pi} \times 100 \quad \text{Expression (3)}$$

[Expression 4]

$$60 \leq C \leq 100 \quad \text{Expression (4)}$$

where in Expressions (3) and (4),

C represents the coverage ratio (%),

N represents the number (ports) of ejection ports of the cooling nozzles,

θ represents an inclination angle (degrees) of each ejection port of the cooling nozzles with respect to a radial direction perpendicular to an axis of the casting billet, α represents a length (mm) of the short side of each ejection port of the cooling nozzles, β represents a length (mm) of the long side of each ejection port of the cooling nozzles, D represents a diameter (mm) of the casting billet, and π represents a circle ratio.

7. A continuous casting device comprising:

the continuous casting mold according to claim 1.

8. A continuous casting method comprising:

manufacturing, using the continuous casting mold according to claim 1, the casting billet pulled out of the cooling casting mold while cooling the casting billet with the coolant water released from the cooling nozzles.

* * * * *